US006591752B2

(12) United States Patent
Blomquist

(10) Patent No.: US 6,591,752 B2
(45) Date of Patent: Jul. 15, 2003

(54) IGNITION MATERIAL FOR AN IGNITER

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 90 days.

(21) Appl. No.: 09/781,939

(22) Filed: Feb. 12, 2001

(65) Prior Publication Data

US 2002/0108686 A1 Aug. 15, 2002

(51) Int. Cl.[7] ..... F42B 3/10
(52) U.S. Cl. ..... 102/202.5; 149/19.8; 149/45
(58) Field of Search ..... 102/202.5; 149/19.8, 149/45

(56) References Cited

U.S. PATENT DOCUMENTS 1,606,413 A * 11/1926 Grant ..... 102/202.3
1,853,373 A * 5/1932 McNutt ..... 149/45
2,410,801 A * 11/1946 Audrieth ..... 149/43
3,473,982 A * 10/1969 Herzog et al. ..... 149/45
3,974,772 A 8/1976 Pelham et al.
4,428,292 A * 1/1984 Riggs ..... 102/202.7
5,070,788 A * 12/1991 Carisella et al. ..... 102/202.1
5,320,691 A 6/1994 Weber
5,403,036 A 4/1995 Zakula et al.
5,542,998 A 8/1996 Bucerius et al.
5,670,098 A 9/1997 Dillehay et al.
5,831,204 A 11/1998 Lubben et al.
6,039,820 A * 3/2000 Hinshaw et al. ..... 149/45
6,096,147 A 8/2000 Taylor et al.
6,143,102 A * 11/2000 Mendenhall et al. ..... 149/45
6,334,961 B1 * 1/2002 Wheatley et al. ..... 149/72

* cited by examiner

*Primary Examiner*—Edward A. Miller
(74) *Attorney, Agent, or Firm*—Tarolli, Sundheim, Covell & Tummino L.L.P.

(57) ABSTRACT

An electrically actuatable igniter (24) comprises a pair of electrodes (40) and (42). A heating element (44) is electrically connected between the electrodes (40) and (42). An ignition material (48) is in contact with the heating element (44). The ignition material (48) includes an energetic composition. The energetic composition comprises, by weight of the energetic composition, about 60% to about 90% basic copper nitrate, up to about 20% supplemental oxidizer, about 5% to about 20% charcoal, and up to about 10% supplemental fuel.

9 Claims, 1 Drawing Sheet

IGNITION MATERIAL FOR AN IGNITER

FIELD OF THE INVENTION

The present invention relates to an igniter, and particularly relates to an ignition material for an igniter for actuating an inflatable vehicle occupant protection apparatus.

BACKGROUND OF THE INVENTION

An inflatable vehicle occupant protection device, such as an air bag, is inflated by inflation gas provided by an inflator. The inflator typically contains ignitable gas generating material. The inflator further includes an igniter to ignite the gas generating material.

The igniter contains a charge of ignition material. The igniter also contains a bridgewire that is supported in a heat transferring relationship with the ignition material. When the igniter is actuated, an actuating level of electric current is directed through the bridgewire in the igniter. This causes the bridgewire to become resistively heated sufficiently to ignite the ignition material. The ignition material then produces ignition products that, in turn, ignite the gas generating material.

An example of an ignition material typically used for igniting a gas generating material is black powder. Black powder is composed of sulfur, charcoal, and potassium nitrate or sodium nitrate. Black powder has several drawbacks when used as an ignition material for igniting a gas generating material. There are restrictions on shipping black powder, and special precautions must be taken when manufacturing black powder. Moreover, black powder is not a completely satisfactory ignition material for LOVA gas generating materials or propellants because it is not sufficiently energetic to ignite the LOVA gas generating materials or propellants. Black powder also does not exhibit low vulnerability characteristics, such as resistance to thermal decomposition and ignition upon shock. Accordingly, it would be desirable to provide an ignition material that is a substitute for black powder and that would be more energetic than black powder as an ignition material, while at the same time exhibiting less vulnerability to thermal decomposition and ignition upon shock.

SUMMARY OF THE INVENTION

The present invention is an electrically actuatable igniter. The electrically actuatable igniter comprises a pair of electrodes. A heating element is electrically connected between said electrodes. An ignition material is in contact with the heating element. The ignition material includes an energetic composition. The energetic composition comprises, by weight of the energetic composition, about 60% to about 90% basic copper nitrate, up to about 20% supplemental oxidizer, about 5% to about 20% charcoal, and up to about 10% supplemental fuel.

The present invention is also directed to an energetic composition that comprises, by weight of the energetic composition about 65% to about 85% basic copper nitrate, up to about 10% supplemental oxidizer, about 10% to about 15% charcoal, and up to about 10% supplemental fuel.

BRIEF DESCRIPTION OF THE DRAWINGS

The foregoing and other features of the invention will become more apparent to one skilled in the art upon consideration of the following description of the invention and the accompanying drawings, in which.

DESCRIPTION OF THE PREFERRED EMBODIMENT

Figure 1:
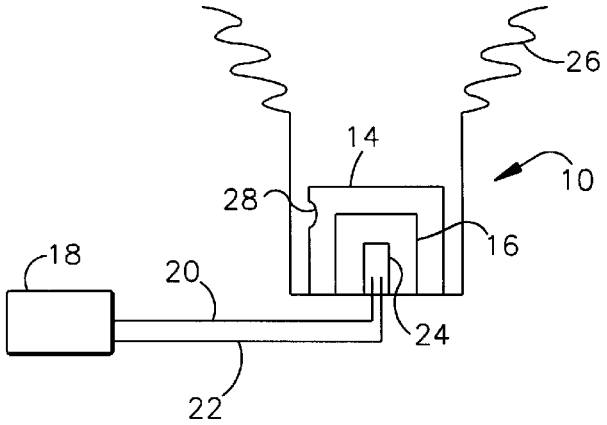
FIG. 1 is a schematic view of a vehicle occupant protection apparatus embodying the present invention.

Referring to FIG. 1, an apparatus 10 embodying the present invention includes an inflator 14 and an inflatable vehicle occupant protection device 26. The inflator 14 contains a gas generating material 16. The gas generating material 16 is ignited by an igniter 24 operatively associated with the gas generating material 16. The igniter 24 is connected by electric leads 20 and 22 in an electric circuit that includes a crash sensor 18 and a power source (not shown). The crash sensor 18 operates to complete the circuit in response to vehicle deceleration indicative of a collision. A gas flow means 28, such as an opening in the inflator 14, conveys gas, which is generated by combustion of the gas generating material 16, to the vehicle occupant protection device 26.

A preferred vehicle occupant protection device 26 is an air bag that is inflatable to help protect a vehicle occupant in the event of a collision. Other vehicle occupant protection devices that can be used with the present invention are inflatable seat belts, inflatable knee bolsters, inflatable air bags to operate knee bolsters, inflatable head liners, and inflatable side curtains.

Figure 2:
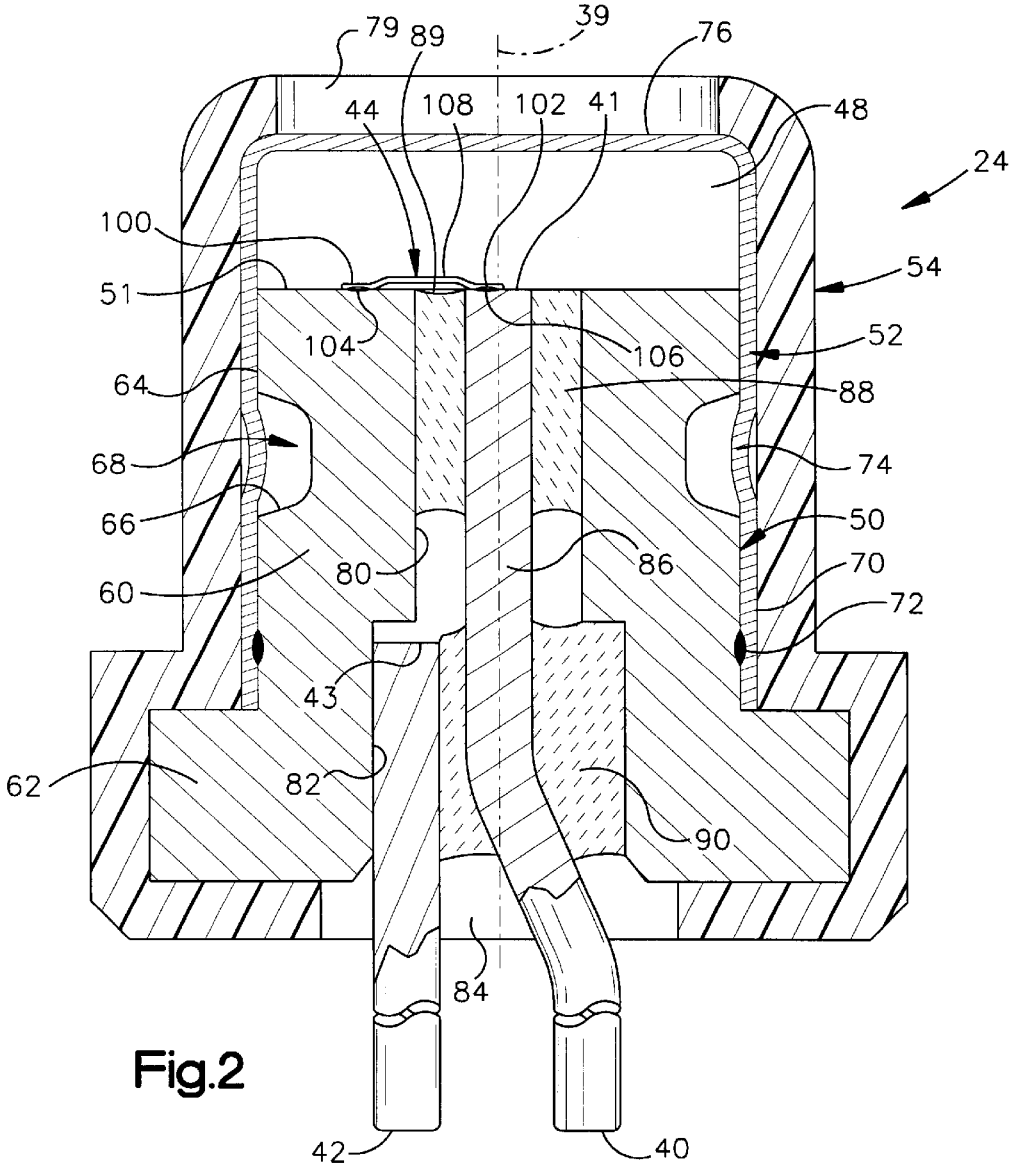
FIG. 2 is an enlarged sectional view of a part of the apparatus of FIG. 1.

Referring to FIG. 2, the igniter 24 has a central axis 39 and a pair of axially projecting electrodes 40 and 42. A heating element in the form of a bridgewire 44 is electrically connected between the electrodes 40 and 42 within the igniter 24. An ignition material 48 is contained within the igniter 24. The ignition material surrounds and is in contact with the bridgewire 44 so that the ignition material is in a heat receiving relationship with the bridgewire 44.

The igniter 24 further includes a header 50, a charge cup 52 and a casing 54. The header 50 is a metal part, preferably made of 304L steel, with a generally cylindrical body 60 and a circular flange 62 projecting radially outward from one end of the body 60. A cylindrical outer surface 64 of the body 60 has a recessed portion 66 defining a circumferentially extending groove 68.

The charge cup 52 also is a metal part, and has a cylindrical side wall 70 received in a tight fit over the body 60 of the header 50. The side wall 70 of the charge cup 52 is fixed and sealed to the body 60 of the header 50 by a circumferentially extending weld 72. The charge cup 52 is further secured to the header 50 by a plurality of circumferentially spaced indented portions 74 of the side wall 70 that are crimped radially inward into the groove 68. In this arrangement, the side wall 70 and a circular end wall 76 of the charge cup 52 together contain and hold the ignition material 48 in a heat transferring relationship with the bridgewire 44. A plurality of thinned portions (not shown) of the end wall 76 function as stress risers that rupture under the influence of the combustion products generated by the ignition material 48.

The casing 54 is a sleeve-shaped plastic part that is shrink-fitted onto the header 50 and the charge cup 52 so as to insulate and partially encapsulate those parts. An opening 79 in the casing 54 allows ignition products escaping through the ruptured thinned portions of the charge cup 52 to exit the igniter 24.

The header 50 has a pair of cylindrical inner surfaces 80 and 82 that are axially aligned and together define a central passage 84 extending fully through the header 50. The first electrode 40 has an inner end portion 86 extending along the entire length of the central passage 84. A pair of axially spaced apart glass seals 88 and 90 surround the first electrode 40 in the central passage 84, and electrically insulate the first electrode 40 from the header 50 and from the electrode 42. Preferably, the glass seals 88 and 90 are formed from a barium alkali silicate glass. The second electrode 42 extends only partially along the length of the central passage 84 and, at one end 43, seats against the header 50 in direct contact with the header 50.

The bridgewire 44 extends from a radially extending surface 41 of the first electrode 40 to a radially extending surface 51 of the header 50. The bridgewire 44 has flattened opposite end portions 100 and 102, which are fixed to the header surface 51 and the electrode surface 41 by electrical resistance welds 104 and 106, respectively. The opposite end portions 100 and 102 of the bridgewire 44 become flattened under the pressure applied by welding electrodes (not shown) that are used to form the resistance welds 104 and 106. The bridgewire 44 thus has an unflattened major portion 108 extending between the opposite end portions 100 and 102. The major portion 108 of the bridgewire 44 is bent so that the major portion 108 lies primarily in a plane spaced from the plane of the opposite end portions 100 and 102, from a radially extending surface 89 of the first glass seal 88, and from the header surface 51.

The bridgewire 44, in one embodiment, is formed from a high resistance metal alloy. A preferred metal alloy is "NICHROME", a nickel-chromium alloy. Other suitable alloys for forming a high resistance bridgewire 44 include platinum-tungsten and 304L steel. An electrical current flow in the bridgewire 44 resistively heats the bridgewire to a temperature of at least about 450° C. The heat generated by the bridgewire 44 is sufficient to ignite the ignition material 48.

A semi-conductor bridge (SCB) may be used in place of the bridgewire 44. A semi-conductor bridge consists of dissimilar conductive materials, such as a thick resistive film on a ceramic substrate, a thin resistive film deposited on a ceramic substrate, or a semi-conductor junction diffusion doped onto a silicon substrate. A current flow in the semi-conductor bridge heats the semi-conductor bridge to a temperature of about 250° C. to about 400° C., which is sufficient to ignite the ignition material 48. An example of semi-conductor bridge includes a substrate that is formed of a ceramic material, such as dense alumina ($Al_2O_3$), beryllia (BeO), or steatite, and an alloy, such as nickel-chrome, phosphorous-chrome, or tantalum nitride, on the substrate.

In accordance with the present invention, the ignition material 48 comprises an energetic composition that deflagrates when the bridgewire 44 is heated to a temperature of at least about 450° C. By deflagrate, it is meant that the energetic composition undergoes an exothermic chemical reaction producing a vigorous evolution of heat and sparks or flame that move through the energetic Composition 48 at a speed less than the speed of sound.

The energetic composition 48 of the present invention comprises an intimate mixture of a particulate fuel and a particulate oxidizer. The particulate fuel is charcoal. The charcoal is present in the energetic composition in the form of a fine powder. The amount of charcoal in the energetic composition is that amount necessary to achieve sustained combustion of the energetic composition. A preferred amount of charcoal in the energetic composition is about 5% to about 20% by weight of the energetic composition. More preferably, the amount of charcoal in the energetic composition is about 10% to about 15% by weight of the energetic composition.

The energetic composition can also comprise a supplemental fuel. The supplemental fuel can be any particulate fuel commonly added to a gas generating material to improve ignitability and combustion properties, such as burn rate, combustion temperature, and impetus. A preferred supplemental fuel is sulfur. Examples of other supplemental fuels than can be used in the energetic composition are organic nitrogen containing fuels, such as guanidine nitrate, cyclotrimethyl enetrinitramine, cyclotetramethylenetetranitramine, cyanuric acid, and mixtures thereof.

The amount of supplemental fuel used in the energetic composition is less than the amount of charcoal powder used in the energetic composition. Preferably, the amount of supplemental fuel in the energetic composition is 0 to about 10% by weight of the energetic composition. More preferably, the amount of supplemental fuel in the energetic composition is 0 to about 5% by weight of the energetic composition.

The particulate oxidizer of the present invention is basic copper nitrate. Basic copper nitrate has the general formula $Cu(NO_3)2.3Cu(OH)_2$. The basic copper nitrate is used in the energetic composition in the form of a fine powder. The amount of basic copper nitrate in the energetic composition is that amount necessary to achieve sustained combustion of the energetic composition. A preferred amount of basic copper nitrate in the energetic composition is about 60% to about 90% by weight of the energetic composition. More preferably, the amount of basic copper nitrate in the energetic composition is about 65% to about 85% by weight of energetic composition.

The energetic composition can also include a supplemental oxidizer to improve ignitability and combustion properties, such as burn rate, combustion temperature, and impetus, of the energetic composition. A preferred supplemental oxidizer is an alkali metal nitrate, such as sodium nitrate and potassium nitrate. Examples of other oxidizers that can be used as a supplemental oxidizer in the energetic composition are inorganic salts, such as ammonium nitrate, strontium nitrate, ammonium perchlorate, and potassium perchlorate, and metal oxides, such as iron oxide, copper oxide, manganese dioxide, and molybdenum trioxide, and mixtures thereof.

The amount of supplemental oxidizer used in the energetic composition is 0 to about 20% by weight of the energetic composition. A preferred amount of supplemental oxidizer used in the energetic composition is about 0 to about 10% by weight of the energetic composition.

The energetic composition can also include other ingredients, such as process aids and non-energetic binders. Examples of these other ingredients are graphite and guar gum. The amount of these other ingredients in the energetic composition of the present invention is from 0 to about 5% by weight of the energetic composition.

One preferred energetic composition comprises, by weight of the energetic composition, about 10% charcoal, about 5% sulfur, about 85% basic copper nitrate, and less than 1% graphite. Another preferred energetic composition comprises, by weight of the energetic composition, about 10% charcoal, about 20% potassium nitrate, about 69% basic copper nitrate, and about 1% graphite. These energetic compositions are preferred because they produce a combustion product that is essentially free of caustic materials, have burn rates that are faster than black powder, and are more resistant to thermal decomposition and ignition by shock than black powder.

The energetic composition of the present invention can be prepared by ball milling the charcoal and supplemental fuel, if utilized, to form a fine powder of the charcoal and the supplemental fuel. The basic copper nitrate and supplement oxidizer, if utilized, are ball milled separately from the charcoal and supplemental fuel to form a fine powder of the basic copper nitrate and supplemental oxidizer.

The charcoal, the supplemental fuel, the basic copper nitrate and supplemental oxidizer are transferred to a Muller mixer. The charcoal, the supplemental fuel, the basic copper nitrate, and the supplemental oxidizer are mulled until an intimate mixture of the charcoal, the supplemental fuel, the basic copper nitrate and the supplemental oxidizer is formed. Water may be added to the Muller mixer during mulling to minimize dust formation, improve incorporation of the basic copper nitrate into the charcoal, and desensitize the mixture.

The mulled powder is transferred to a hydraulic press where it is consolidated into cakes by applying pressure of at least about 41.3 MPa (6000 psi) to discrete portions of the powder. The cakes are manually removed from the hydraulic press and broken into chunks by a coarse-toothed crusher. The chunks are transferred to a Corning mill. The Corning mill includes adjustable corrugated rollers that are cascaded. The chunks are crushed into coarse particles by the corrugated rollers. The coarse particles are then screened to form an energetic composition with the desired particle size.

Alternatively, the ball milled charcoal, supplemental fuel, basic copper nitrate, and supplemental oxidizer are transferred to a twin screw extruder instead of a Muller mixer. A minimal amount of water is added to the mixture in the extruder, and the mixture is compounded to form a paste suitable for extrusion. The paste is extruded through a die and cut to desired length. The extrudate is dried and then crushed to form an energetic composition with the desired particle size.

The particles of energetic composition so formed can be used as the sole component of the ignition material. When used as the sole component of the ignition material, the particles of the energetic composition are pressed into the ignition cup so that the energetic composition occupies a substantial portion of the ignition cup.

Optionally, the energetic composition can be combined with an energetic binder to form a solid mass of ignitable material. A preferred energetic binder is nitrocellulose. Examples of other energetic binders include polyethers and polyazides. The amount of energetic binder in the ignition material is that amount necessary to form a solid mass of ignition material. Preferably, the amount of energetic binder in the ignitable material is about 0 to about 40% by weight of the ignition material. The solid mass of ignition material is pressed into the ignition cup so that solid mass of ignition material occupies a substantial portion of the ignition cup.

When the igniter 24 is actuated, an actuating level of electric current is directed through the bridgewire 44 between the electrodes 40 and 42. As the actuating level of the electric current is conducted through the bridgewire 44, the bridgewire 44 is heated to a temperature of about 450° C. The heat is transferred directly to the ignition material 48. The particles of ignition material adjacent to the bridgewire 44 ignite, resulting in deflagration of the ignition material. Deflagration of the ignition material produces ignition products, including heat, hot gases and hot particles. The ignition products are spewed outward from the igniter 24 and ignite the gas generating material.

EXAMPLE

The following Example illustrates the preparation of an energetic composition in accordance with the present invention. 10 mg of charcoal and 5 mg of sulfur are pulverized in a ball mill to form a uniform mixture of charcoal and sulfur. 85 milligrams of basic copper nitrate are pulverized separately from the charcoal and sulfur. The pulverized charcoal and sulfur mixture and the pulverized basic copper nitrate are transferred to a Muller mixer. About 5 ml of water are added to the Muller mixer to reduce dust formation, improve mixing, and desensitize the mixture. The mixture of charcoal, sulfur, and basic copper nitrate is mulled until an intimate mixture is formed. The mulled powder is transferred to a hydraulic press where it is consolidated into cakes by apply a pressure of about 41.3 MPa (6000 psi) to discrete portions of the powder. The cakes are manually removed from the hydraulic press and broken into chunks by a coarse-toothed crusher. The chunks are transferred to a Corning mill and crushed into coarse particles. The coarse particles are screened to form the energetic composition.

The energetic composition so formed has a burn rate greater that about 1.5 cm/sec. at 6.9 MPa. The energetic composition is also resistant to thermal decomposition and ignition by shock. Moreover, the energetic composition produces a combustion product that is essentially free of caustic materials.

From the above description of the invention, those skilled in the art will perceive improvements, changes and modifications. Such improvements, changes and modifications within the skill of the art are intended to be covered by the appended claims.

Having described the invention, the following is claimed:

1. An electrically actuatable igniter comprising:

a pair of electrodes;

a heating element electrically connected between said electrodes; and an ignition material in contact with said heating element, said ignition material including anenergetic composition that comprises, by weight of energetic composition, about 60% to about 90% basic copper nitrate, up to about 20% supplemental oxidizer, about 5% to about 20% charcoal, and up to about 10% supplemental fuel.

2. The igniter of claim 1 wherein the supplemental fuel is sulfur.

3. The igniter of claim 1 wherein the supplemental fuel is selected from the group consisting of potassium nitrate and sodium nitrate.

4. The igniter of claim 1, wherein the energetic composition further comprises a processing aid or a binder.

5. The igniter of claim 1, wherein the ignition material further comprises up to about 40%, by weight of ignition material, an energetic binder.

6. The igniter of claim 5, wherein the energetic binder is nitrocellulose.

7. An energetic composition comprising, by weight of the energetic composition, about 65% to about 85% basic copper nitrate, up to about 10% supplemental oxidizer, about 10% to about 15% charcoal, and up to about 5% supplemental fuel.

8. An energetic composition consisting essentially of basic copper nitrate, charcoal, and sulfur.

9. An energetic composition comprising, by weight of the energetic composition, about 10% charcoal, about 5% sulfur, about 85% basic copper nitrate, and less than 1% graphite.

* * * * *